US010101054B2

(12) United States Patent
Huang

(10) Patent No.: US 10,101,054 B2
(45) Date of Patent: Oct. 16, 2018

(54) VARIABLE REFRIGERANT FLOW AIR CONDITIONING SYSTEM WITH DUAL CONTROL OVER TEMPERATURE AND HUMIDITY AND CONTROL METHOD THEREOF

(71) Applicants: GD MIDEA HEATING & VENTILATING EQUIPMENT CO., LTD., Foshan (CN); MIDEA GROUP CO., LTD., Foshan (CN)

(72) Inventor: Zhao Huang, Foshan (CN)

(73) Assignees: GD MIDEA HEATING & VENTILATING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 0 days.

(21) Appl. No.: 15/503,478

(22) PCT Filed: Apr. 26, 2016

(86) PCT No.: PCT/CN2016/080249

§ 371 (c)(1),
(2) Date: Feb. 13, 2017

(87) PCT Pub. No.: WO2017/000642

PCT Pub. Date: Jan. 5, 2017

(65) Prior Publication Data

US 2018/0100668 A1 Apr. 12, 2018

(30) Foreign Application Priority Data

Jun. 30, 2015 (CN) ..... 2015 1 0377686

(51) Int. Cl.
*F24F 11/84* (2018.01)
*F24F 11/89* (2018.01)
(Continued)

(52) U.S. Cl.
CPC ..... *F24F 11/84* (2018.01); *F24F 1/0003* (2013.01); *F24F 11/0008* (2013.01);
(Continued)

(58) Field of Classification Search
CPC ..... F24F 11/0008; F24F 11/84; F24F 11/89; F24F 2110/10; F24F 2110/20;
(Continued)

(56) References Cited

U.S. PATENT DOCUMENTS 9,726,387 B2 * 8/2017 Karkhanis ..... F24F 3/1405
2006/0254294 A1 11/2006 Shimamoto et al.
(Continued)

FOREIGN PATENT DOCUMENTS

CN 1695034 A 11/2005
CN 104896682 A 9/2015

OTHER PUBLICATIONS

Chinese Patent Application No. 201510377686.0, First Office Action dated May 17, 2017, 8 pages.
(Continued)

*Primary Examiner* — Marc Norman
(74) *Attorney, Agent, or Firm* — Lathrop Gage LLP

(57) ABSTRACT

The disclosure discloses a variable refrigerant flow (VRF) air conditioning system with dual control over temperature and humidity and a control method thereof, in which the VRF air conditioning system includes multiple indoor machines, an outdoor machine and a controller; the outdoor machine is provided with a first connector and a second connector; each indoor machine includes an indoor throttle valve, a first heat exchanger, a second heat exchanger, a first solenoid valve, a second solenoid valve, a third solenoid valve, a temperature detector and a humidity detector; the controller controls the VRF air conditioning system by controlling the indoor throttle valve, the first solenoid valve,
(Continued)

the second solenoid valve and the third solenoid valve in each indoor machine.

17 Claims, 3 Drawing Sheets

(51) Int. Cl.
*F24F 1/00* (2011.01)
*F24F 11/00* (2018.01)
*F24F 110/20* (2018.01)
*F24F 110/10* (2018.01)

(52) U.S. Cl.
CPC ..... *F24F 11/89* (2018.01); *F24F 2110/10* (2018.01); *F24F 2110/20* (2018.01)

(58) Field of Classification Search
CPC ..... F25B 41/04; F25B 41/06; F25B 41/062; F25B 2313/232; F25B 2313/0233; F25B 2400/0409; F25B 2600/2501; F25B 2600/2511
See application file for complete search history.

(56) References Cited

U.S. PATENT DOCUMENTS

2011/0232308 A1* 9/2011 Morimoto ..... F25B 13/00 62/132
2014/0245758 A1* 9/2014 Gu ..... F25D 29/00 62/56
2018/0106505 A1* 4/2018 Mislak ..... F25B 13/00

OTHER PUBLICATIONS

Chinese Patent Application No. 201510377686.0, English translation of First Office Action dated May 17, 2017, 9 pages.
PCT/CN2016/080249 International Search Report & Written Opinion, dated Jun. 24, 2016, 16 pages.

* cited by examiner

VARIABLE REFRIGERANT FLOW AIR CONDITIONING SYSTEM WITH DUAL CONTROL OVER TEMPERATURE AND HUMIDITY AND CONTROL METHOD THEREOF

CROSS REFERENCE TO RELATED APPLICATION

This application is a US national phase application of an International Application No. PCT/CN2016/080249 filed on Apr. 26, 2016, which claims priority to and benefits of Chinese Patent Application No. 201510377686.0, filed with State Intellectual Property Office on Jun. 30, 2015, the entire content of which is incorporated herein by reference.

FIELD

The present disclosure relates to a field of air conditioning technologies, and particularly, to a variable refrigerant flow (VRF) air conditioning system with dual control over temperature and humidity and a control method thereof.

BACKGROUND

In the related art, indoor machines are usually divided into two parts through series connection to realize a constant-temperature dehumidification technology of an air conditioning system; during dehumidification, one part of the indoor machines act as a condenser, while the other part thereof act as an evaporator. However, when the air conditioning system is in normal operation, a refrigerant flow path will becomes very long, which affects the performance of the air conditioning system in normal operation and is not energy-saving and environmental friendly.

SUMMARY

The present disclosure aims to solve one of the technical problems above in the related art to at least some extent. Accordingly, an objective of the present disclosure is to provide a VRF air conditioning system with dual control over temperature and humidity that satisfies a requirement of dual control over temperature and humidity without influencing normal refrigerating and heating performances, so as to fully meet user demands.

Another objective of the present disclosure is to provide a control method for a VRF air conditioning system with dual control over temperature and humidity.

To achieve the objectives, according to a first aspect of embodiments of the present disclosure, there is provided a VRF air conditioning system with dual control over temperature and humidity, including: an outdoor machine having a first connector and a second connector, a plurality of indoor machines and a controller. Each of the plurality of indoor machines includes: an indoor throttle valve having a first end connected with the first connector; a first solenoid valve having a first end connected with a second end of the indoor throttle valve; a first heat exchanger and a second heat exchanger, in which a first end of the first heat exchanger is connected with a first end of the second heat exchanger, and a first node is provided between the first end of the first heat exchanger and the first end of the second heat exchanger and is connected with a second end of the first solenoid valve; a second solenoid valve having a first end connected with the first end of the first solenoid valve and the second end of the indoor throttle valve respectively, and a second end connected with a second end of the second heat exchanger, in which a second node is provided between the second end of the second solenoid valve and the second end of the second heat exchanger; a third solenoid valve having a first end connected with the second node, and a second end connected with a second end of the first heat exchanger and the second connector respectively; a temperature detector configured to detect an indoor environment temperature; and a humidity detector configured to detect indoor environment relative humidity. The controller is connected with the indoor throttle valve, the first solenoid valve, the second solenoid valve, the third solenoid valve, the temperature detector and the humidity detector of each indoor machine respectively, and is configured to control the VRF air conditioning system through control over the indoor throttle valve, the first solenoid valve, the second solenoid valve and the third solenoid valve of each indoor machine.

To achieve the objectives, according to a second aspect of embodiments of the present disclosure, a control method for a VRF air conditioning system with dual control over temperature and humidity is provided, in which the VRF air conditioning system with dual control over temperature and humidity includes a plurality of indoor machines and an outdoor machine; the outdoor machine has a first connector and a second connector; each of the plurality of indoor machines includes an indoor throttle valve, a first solenoid valve, a first heat exchanger and a second heat exchanger, a second solenoid valve, and a third solenoid valve; a first end of the indoor throttle valve is connected with the first connector, and a first end of the first solenoid valve is connected with a second end of the indoor throttle valve; a first end of the first heat exchanger is connected with a first end of the second heat exchanger, and a first node is provided between the first end of the first heat exchanger and the first end of the second heat exchanger; the first node is connected with a second end of the first solenoid valve; a first end of the second solenoid valve is connected with the first end of the first solenoid valve and the second end of the indoor throttle valve respectively, a second end of the second solenoid valve is connected with a second end of the second heat exchanger, and a second node is provided between the second end of the second solenoid valve and the second end of the second heat exchanger; a first end of the third solenoid valve is connected with the second node, and a second end of the third solenoid valve is connected with a second end of the first heat exchanger and the second connector respectively. The control method includes following steps: detecting an indoor environment temperature corresponding to each indoor machine, and detecting indoor environment relative humidity corresponding to each indoor machine; and controlling the VRF air conditioning system through control over the indoor throttle valve, the first solenoid valve, the second solenoid valve and the third solenoid valve of each indoor machine, according to the indoor environment temperature corresponding to each indoor machine and the indoor environment relative humidity corresponding to each indoor machine.

DETAILED DESCRIPTION

Figure 1:
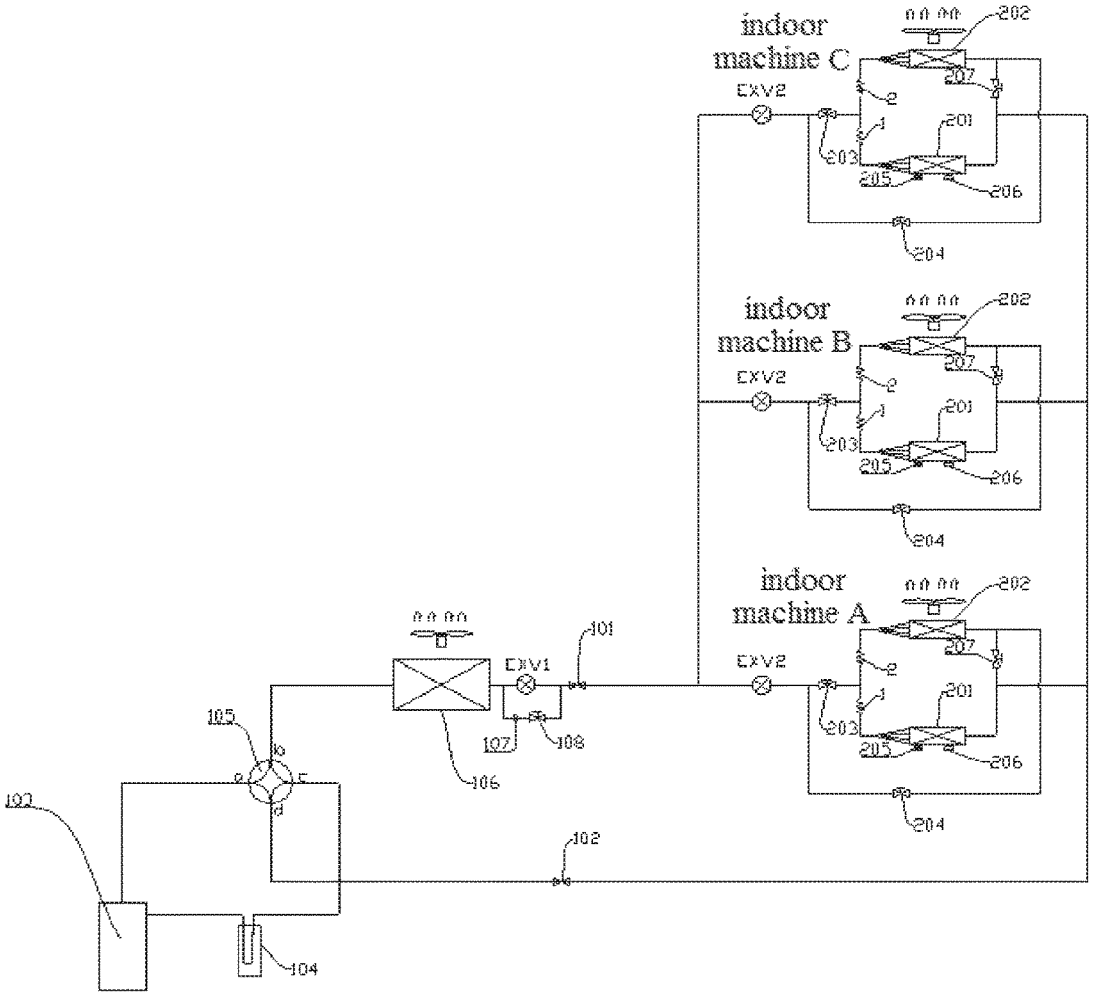
FIG. 1 is a schematic view of a VRF air conditioning system with dual control over temperature and humidity according to an embodiment of the present disclosure.

Embodiments of the present disclosure will be described in detail and examples of the embodiments will be illustrated in the accompanying drawings. The same or similar elements and the elements having same or similar functions are denoted by like reference numerals throughout the descriptions. The embodiments described herein with reference to the drawings are explanatory, which aim to illustrate the present disclosure, but shall not be construed to limit the present disclosure.

In the following, a VRF air conditioning system with dual control over temperature and humidity and a control method thereof according to embodiments of the present disclosure will be described with reference to the drawings.

FIG. 1 is a schematic view of a VRF air conditioning system with dual control over temperature and humidity according to an embodiment of the present disclosure. As shown in FIG. 1, the VRF air conditioning system includes a plurality of indoor machines, such as indoor machine A, indoor machine B and indoor machine C, an outdoor machine and a controller, in which the outdoor machine has a first connector 101 and a second connector 102, and the outdoor machine includes a compressor 103, a liquid storage tank 104, a four-way valve 105, an outdoor heat exchanger 106 and an outdoor throttle valve, e.g. an electronic expansion valve EXV1.

As shown in FIG. 1, each indoor machine includes an indoor throttle valve, e.g. an electronic expansion valve EXV2, a first heat exchanger 201, a second heat exchanger 202, a first solenoid valve 203, a second solenoid valve 204, a third solenoid valve 207, a temperature detector 205 and a humidity detector 206. A first end of the indoor throttle valve, e.g. the electronic expansion valve EXV2, is connected with the first connector 101; a first end of the first solenoid valve 203 is connected with a second end of the indoor throttle valve, e.g. the electronic expansion valve EXV2; a first end of the first heat exchanger 201 is connected with a first end of the second heat exchanger 202, and a first node is provided between the first end of the first heat exchanger 201 and the first end of the second heat exchanger 202; the first node is connected with a second end of the first solenoid valve 203. Specifically, as shown in FIG. 1, a first throttling element 1 may be further provided between the first node and the first end of the first heat exchanger 201, while a second throttling element 2 may be further provided between the first node and the first end of the second heat exchanger 202; the first throttling element 1 and the second throttling element 2 may be capillary tubes, electronic throttling components or other throttling components, and only one of the first throttling element 1 and the second throttling element 2 may be present while the other one thereof is replaced with a straight tube, or both of them are removed; for a dehumidification requirement, two bypass capillary assemblies of the indoor machine are used to throttle and depressurize. A first end of the second solenoid valve 204 is connected with the first end of the first solenoid valve 203 and the second end of the indoor throttle valve EXV2 separately, a second end of the second solenoid valve 204 is connected with a second end of the second heat exchanger 202, and a second node is provided between the second end of the second solenoid valve 204 and the second end of the second heat exchanger 202; a first end of the third solenoid valve 207 is connected with the second node, and a second end of the third solenoid valve 207 is connected with a second end of the first heat exchanger 201 and the second connector 102 separately.

The temperature detector 205 is configured to detect an indoor environment temperature, in which a temperature sensor may be provided at an air return port of the first heat exchanger 201 to detect return air temperature $T_r$ so as to detect the indoor environment temperature. The humidity detector 206 is configured to detect indoor environment relative humidity. The controller is connected with the indoor throttle valve, e.g. the electronic expansion valve EXV2, the first solenoid valve 203, the second solenoid valve 204, the third solenoid valve 207, the temperature detector 205 and the humidity detector 206 of each indoor machine separately, and is configured to control the VRF air conditioning system through control over the indoor throttle valve, e.g. the electronic expansion valve EXV2, the first solenoid valve 203, the second solenoid valve 204 and the third solenoid valve 207 of each indoor machine, according to the indoor environment temperature and the indoor environment relative humidity corresponding to each indoor machine.

In an embodiment of the present disclosure, the controller is configured to calculate a temperature difference value ΔT1 between the indoor environment temperature (like $T_r$) corresponding to each indoor machine and a set temperature $T_s$, and judge a prioritized operation mode for the current VRF air conditioning system and an operation state of each indoor machine. If it is judged that the prioritized operation mode for the current VRF air conditioning system is a heating-prioritized mode, an indoor machine operating in a heating mode exists in the current VRF air conditioning system, an indoor machine operating in a temperature and humidity control mode exists in the current VRF air conditioning system, and ΔT1 corresponding to the indoor machine operating in the temperature and humidity control mode is greater than a first preset temperature (e.g. −1° C.), then the controller controls the indoor machine operating in the temperature and humidity control mode to stop running. Since the indoor machine operating in the temperature and humidity control mode cannot achieve a decrease in the corresponding indoor environment temperature, the humidity control is put to rest until the temperature control returns to normal control.

Furthermore, if it is judged that the prioritized operation mode for the current VRF air conditioning system is the heating-prioritized mode, an indoor machine operating in the heating mode exists in the current VRF air conditioning system, an indoor machine operating in the temperature and humidity control mode exists in the current VRF air conditioning system, and the ΔT1 corresponding to the indoor machine operating in the temperature and humidity control mode is less than or equal to the first preset temperature, then the controller further judges the ΔT1 corresponding to the indoor machine operating in the temperature and humidity control mode, and at this time the four-way valve is in a power-on state with point a in communication with point d and point b in communication with point c. When the ΔT1 corresponding to the indoor machine operating in the temperature and humidity control mode is less than a second preset temperature (e.g. −3° C.), the controller controls the first solenoid valve 203 and the third solenoid valve 207 of the indoor machine operating in the temperature and humidity control mode to turn on, and controls the second solenoid valve 204 of the indoor machine operating in the temperature and humidity control mode to turn off, such that the indoor machine operating in the temperature and humidity control mode starts to operate in the heating mode, in which the second preset temperature is less than the first preset temperature. When the ΔT1 corresponding to the indoor machine operating in the temperature and humidity control mode is greater than or equal to the second preset temperature and less than or equal to the first preset temperature, the controller controls the first solenoid valve 203 and the third solenoid valve 207 of the indoor machine operating in the temperature and humidity control mode to turn off, and controls the second solenoid valve 204 of the indoor machine operating in the temperature and humidity control mode to turn on, such that the first heat exchanger 201 in the indoor machine operating in the temperature and humidity control mode acts as a condenser for heating and warming, and the second heat exchanger 202 in the indoor machine operating in the temperature and humidity control mode acts as an evaporator for refrigerating and dehumidifying, and meanwhile the controller degrades evaporation of the evaporator by increasing an opening degree of the indoor throttle valve of the indoor machine operating in the temperature and humidity control mode.

That is, if the VRF air conditioning system adopts a heating-prioritized control principle, the indoor machine in the heating mode is turned on for normal heating (the four-way valve is powered on, with point a in communication with point d and point b in communication with point c, and the first solenoid valves and the third solenoid valves in these heating indoor machines are turned on and the second solenoid valves therein are turned off), and an indoor machine in a refrigerating mode reports a mode conflict. If the ΔT1 corresponding to the indoor machine operating in the temperature and humidity control mode is less than or equal to −1° C., the indoor machine is started, and a further judgment is made if ΔT1≤−1° C.; if ΔT1<−3° C., the first solenoid valve and the third solenoid valve of the indoor machine started in the temperature and humidity control mode are turned on, the second solenoid valve thereof is turned off, the four-way valve keeps the power-on state, and the indoor throttle valve EXV2 performs rapid heating in a conventional heating manner, so as to raise the room temperature quickly; if −3° C.≤ΔT1≤−1° C., the first solenoid valve and the third solenoid valve of the indoor machine started in the temperature and humidity control mode are turned off, the second solenoid valve of the indoor machine started in the temperature and humidity control mode is turned on, the four-way valve keeps the power-on state, and the EXV2 is regulated to enhance condensation heat of the first heat exchanger as the condenser in the indoor machine, thus raising the room temperature slowly, in which the regulation speed for opening degree of the EXV2 may be determined according to a value of ΔT1, i.e. the greater an absolute value of ΔT1 is, the larger the regulation range of the EXV2 is, but still with maximum and minimum opening limits.

In an embodiment of the present disclosure, if it is judged that the prioritized operation mode for the current VRF air conditioning system is the heating-prioritized mode and no indoor machine operating in the heating mode exists in the current VRF air conditioning system, or if it is judged that the prioritized operation mode for the current VRF air conditioning system is a refrigerating-prioritized mode, at this time the four-way valve is in a power-off state with point a in communication with point b and point c in communication with point d. When the ΔT1 corresponding to the indoor machine operating in the temperature and humidity control mode is less than or equal to a third preset temperature (e.g. −1° C.), the controller controls the first solenoid valve 203 and the third solenoid valve 207 of the indoor machine operating in the temperature and humidity control mode to turn off, and controls the second solenoid valve 204 of the indoor machine operating in the temperature and humidity control mode to turn on, such that the second heat exchanger in the indoor machine operating in the temperature and humidity control mode acts as the condenser for heating and warming, and the first heat exchanger in the indoor machine operating in the temperature and humidity control mode acts as the evaporator for refrigerating and dehumidifying, and the controller degrades evaporation of the evaporator by increasing the opening degree of the indoor throttle valve EXV2 in the indoor machine operating in the temperature and humidity control mode. When the ΔT1 corresponding to the indoor machine operating in the temperature and humidity control mode is greater than or equal to a fourth preset temperature (e.g. 1° C.) and less than or equal to a fifth preset temperature (e.g. 2° C.), the controller controls the first solenoid valve 203 and the third solenoid valve 207 of the indoor machine operating in the temperature and humidity control mode to turn off, and controls the second solenoid valve 204 of the indoor machine operating in the temperature and humidity control mode to turn on, such that the second heat exchanger in the indoor machine operating in the temperature and humidity control mode acts as the condenser for heating and warming, and the first heat exchanger in the indoor machine operating in the temperature and humidity control mode acts as the evaporator for refrigerating and dehumidifying, and the controller degrades condensation of the condenser by decreasing the opening degree of the indoor throttle valve EXV2 in the indoor machine operating in the temperature and humidity control mode. When the ΔT1 corresponding to the indoor machine operating in the temperature and humidity control mode is greater than the fifth preset temperature, the controller controls the first solenoid valve and the third solenoid valve of the indoor machine operating in the temperature and humidity control mode to turn on, and controls the second solenoid valve of the indoor machine operating in the temperature and humidity control mode to turn off, such that the indoor machine operating in the temperature and humidity control mode starts to operate in the refrigerating mode.

That is, if the VRF air conditioning system adopts a refrigerating-prioritized control principle, the indoor machine in the refrigerating mode is turned on for normal refrigeration (the four-way valve is powered off, with point a in communication with point b and point c in communication with point d, and the first solenoid valves and the third solenoid valves in these refrigerating indoor machines are turned on and the second solenoid valves therein are turned off), and by regulating the opening degree of its EXV2, the indoor machines in the heating mode achieves an increase in the proportion of condensation heat of these indoor machines so as to raise the room temperature slowly. For the indoor machine started in the temperature and humidity control mode, if ΔT1>2° C., the first solenoid valve and the third solenoid valve of the indoor machine operating in the temperature and humidity control mode are turned on, the second solenoid valve of the indoor machine operating in the temperature and humidity control mode is turned off, the room temperature is lowered quickly according to a refrigerating manner, and the EXV2 is controlled in the normal refrigerating manner. For the indoor machine started in the temperature and humidity control mode, if 1° C.≤ΔT1≤2° C., the first solenoid valve and the third solenoid valve of the indoor machine started in the temperature and humidity control mode are turned off, the second solenoid valve of the indoor machine started in the temperature and humidity control mode is turned on, the EXV2 therein is controlled and its opening degree is reduced appropriately, so as to reduce the condensation heat of the indoor machine and lower the room temperature slowly, in which the regulation speed for opening degree of the EXV2 may be determined according to the value of ΔT1, i.e. the greater the absolute vale of ΔT1 is, the larger the regulation range of the EXV2 is, but still with maximum and minimum opening limits. For the indoor machine started in the temperature and humidity control mode, if ΔT1≤−1° C., the first solenoid valve and the third solenoid valve of the indoor machine started in the temperature and humidity control mode are turned off, the second solenoid valve of the indoor machine started in the temperature and humidity control mode is turned on, the EXV2 therein is controlled and its opening degree is increased appropriately, so as to degrade the evaporation of the indoor machine and raise the room temperature slowly, in which the regulation speed for opening degree of the EXV2 may be determined according to the value of ΔT1, i.e. the greater the absolute vale of ΔT1 is, the larger the regulation range of the EXV2 is, but still with maximum and minimum opening limits.

Also, if the VRF air conditioning system adopts the heating-prioritized control principle, but no indoor machine in the heating mode exists in the system (i.e. the indoor machine turned on in the system is an indoor machine in the refrigerating mode or in the temperature and humidity control mode), the indoor machine in the refrigerating mode is turned on for normal refrigeration (the four-way valve is powered off, with point a in communication with point b and point c in communication with point d, and the first solenoid valves and the third solenoid valves in these refrigerating indoor machines are turned on and the second solenoid valves therein are turned off). Similarly, for the indoor machine started in the temperature and humidity control mode, if ΔT1>2° C., the first solenoid valve and the third solenoid valve of the indoor machine operating in the temperature and humidity control mode are turned on, the second solenoid valve of the indoor machine operating in the temperature and humidity control mode is turned off, the room temperature is lowered quickly according to a refrigerating manner, and the EXV2 is controlled in the normal refrigerating manner. For the indoor machine started in the temperature and humidity control mode, if 1° C.≤ΔT1≤2° C., the first solenoid valve and the third solenoid valve of the indoor machine started in the temperature and humidity control mode are turned off, the second solenoid valve of the indoor machine started in the temperature and humidity control mode is turned on, the EXV2 therein is controlled and its opening degree is reduced appropriately, so as to reduce the condensation heat of the indoor machine and lower the room temperature slowly, in which the regulation speed for opening degree of the EXV2 may be determined according to the value of ΔT1, i.e. the greater the absolute vale of ΔT1 is, the larger the regulation range of the EXV2 is, but still with maximum and minimum opening limits. For the indoor machine started in the temperature and humidity control mode, if ΔT1≤−1° C., the first solenoid valve and the third solenoid valve of the indoor machine started in the temperature and humidity control mode are turned off, the second solenoid valve of the indoor machine started in the temperature and humidity control mode is turned on, the EXV2 therein is controlled and its opening degree is increased appropriately, so as to degrade the evaporation of the indoor machine and raise the room temperature slowly, in which the regulation speed for opening degree of the EXV2 may be determined according to the value of ΔT1, i.e. the greater the absolute vale of ΔT1 is, the larger the regulation range of the EXV2 is, but still with maximum and minimum opening limits.

In the embodiment of the present disclosure, the control over the VRF indoor machines in the case of no humidity requirement is the same as the control over conventional indoor machines, and the parameters in this part are fed back to the indoor machines for control over a frequency of the compressor, a wind grade of an outdoor fan, and the outdoor throttle valve, e.g. the electronic expansion valve EXV1. In the presence of humidity requirement, the following control principles need to be satisfied.

(1) In the refrigerating mode, the heating mode and the temperature and humidity control mode, the frequency of the compressor is controlled as: $F_c+F_1+F_2 \ldots F_n$ ($F_c$ represents a frequency required in the conventional refrigerating or heating manner, $F_1$ represents an increment of frequency required by a first indoor machine with dual control over temperature and humidity, $F_2$ represents an increment of frequency required by a second indoor machine with dual control over temperature and humidity, and so on).

(2) In the refrigerating mode, the heating mode and the temperature and humidity control mode, the outdoor fan is controlled in such a way that the wind grade is controlled according to high and low pressure of the system, or according to a temperature of an outdoor condenser in combination with an operating frequency of the compressor and an outdoor environment temperature.

(3) Respective EXV2 of all the indoor machines are associated with parameters of other indoor machines besides their own parameters; when an indoor machine with dual control over temperature and humidity is present, and when EXV2 of this indoor machine cannot meet a requirement for a target change of ΔT1 even if the EXV2 is increased to the maximum opening degree or decreased to the minimum opening degree as required, the EXV2 coordinates with EXV2 of other running indoor machines to perform distribution adjustment—decreasing the opening degree(s) of EXV2 of other indoor machine(s) to increase a refrigerant flow rate through the indoor machine with dual control over temperature and humidity, and increasing the opening degree(s) of EXV2 of other indoor machine(s) to reduce the refrigerant flow rate through the indoor machine with dual control over temperature and humidity, so as to achieve the control target.

(4) The outdoor throttle valve EXV1 is normally controlled as a conventional outdoor machine (without dual control over temperature and humidity).

(5) When the four-way valve is powered on, in the conventional heating manner, the temperature of the indoor machine with the humidity requirement cannot be lowered but raised.

(6) When the four-way valve is powered off, in the conventional refrigerating manner, the temperature of the indoor machine with the humidity requirement can be raised or lowered, but in a slow fashion.

(7) In the current system, when none of the indoor machines has the humidity requirement, there is no difference from the conventional VRF air conditioning system, the first solenoid valve and the third solenoid valve of each indoor machine are turned on, and the second solenoid valve thereof is turned off.

(8) If the system adopts a principle giving priority to a first-operated indoor machine, it is first judged whether the mode of the first-operated indoor machine is a refrigerating mode or a heating mode; if priority is given to the first-operated indoor machine and the mode thereof is the refrigerating mode, the case is the same as the refrigerating-prioritized principle; if priority is given to the first-operated indoor machine and the mode thereof is the heating mode, the case is the same as the heating-prioritized principle.

(9) In the presence of oil return requirement, the system is controlled in a normal oil return manner, the first solenoid valve and the third solenoid valve of each indoor machine are turned on, and the second solenoid valve thereof is turned off.

It can be known from the above that when the indoor machines in the VRF air conditioning system with dual control over temperature and humidity normally operate in the heating mode or the refrigerating mode, the first solenoid valves 203 and the third solenoid valves 207 are controlled to turn on, the second solenoid valves 204 are controlled to turn off, and the electronic expansion valves EXV2 conduct normal regulation, without any difference from the conventional indoor machines for normal heating or refrigeration, which may avoid lengthening the refrigerant flow path and hence affecting the capacity during normal operation when the indoor machines are divided into two parts through series connection.

In an embodiment of the present disclosure, the indoor machine started in the temperature and humidity control mode also needs to take a coordinated control over humidity, in which in the presence of coordinated control over humidity, each indoor machine may further include a humidifier configured to humidify the indoor environment, and the controller is further configured to control the corresponding humidifier to turn on or off based on the indoor environment relative humidity corresponding to the indoor machine operating in the temperature and humidity control mode, such that the indoor environment relative humidity corresponding to the indoor machine operating in the temperature and humidity control mode may meet preset requirements.

Specifically, after the VRF air conditioning system with dual control over temperature and humidity enters the temperature and humidity control mode for dehumidification, the indoor environment relative humidity becomes lower and lower; indoor environment relative humidity H1 may be calculated based on $T_{wet\ bulb}$ and $T_{return\ air}$ ($T_{return\ air}$ may be regarded as the indoor environment temperature, i.e. a dry bulb temperature), and the humidifier is turned on or off based on preset target relative humidity HS (a value of HS generally ranges from 0.4 to 0.7) in a coordinated way; if a difference value (H1−HS) between the indoor environment relative humidity and the target relative humidity is less than −10%, the humidifier is turned on; if H1−HS>10%, the humidifier is turned off and the first heat exchanger in the indoor machine acts as the evaporator for dehumidification to ensure −10%≤H1−HS≤10%. If no specific target relative humidity HS is preset, the humidifier is controlled according to a default humidity value; it is judged whether the current indoor environment relative humidity is greater than or equal to 70%, and if yes, the humidifier is turned off and the first heat exchanger in the indoor machine acts as the evaporator for dehumidification; it is judged whether the current indoor environment relative humidity is less than or equal to 40%, and if yes, the humidifier is turned on and utilized for humidification, so as to maintain more comfortable room humidity.

In the embodiment of the present disclosure, water of the humidifier may be obtained by filtering condensation water from the evaporator, or for more convenience of water supply, the humidifier may be mounted by adding a port through electric control from which a power line leads to a predetermined position in the indoor environment.

In conclusion, in the case of the normal refrigerating or heating requirements, the VRF air conditioning system with dual control over temperature and humidity according to the embodiments of the present disclosure may keep consistent with the conventional VRF air conditioning system, and avoid an excessively long refrigerant flow path; in the case of the humidity requirement, through the control of several valves, one of the first heat exchanger and the second heat exchanger of the indoor machine started in the temperature and humidity control mode may act as the evaporator while the other one thereof may act as the condenser, thus meeting the dehumidification requirement, and by adding the humidifier, a control requirement for constant temperature and humidity may be realized to fully meet user demands.

In the embodiment of the present disclosure, as shown in FIG. 1, a unidirectional valve assembly 107 and a fourth solenoid valve 108 connected in series may be provided in the outdoor machine, and the unidirectional valve assembly 107 and the fourth solenoid valve 108 connected in series may be connected in parallel with the outdoor throttle valve, e.g. the electronic expansion valve EXV1. In such a way, in the presence of a heating requirement for the room, if an increase in the room temperature still cannot be achieved when the outdoor machine stops the outdoor fan or EXV1 is regulated to the maximum opening degree, the fourth solenoid valve 108 may be turned on to release the condensation heat in the room as far as possible, so as to raise the room temperature.

In an embodiment of the present disclosure, when the VRF air conditioning system with dual control over temperature and humidity performs rapid defrosting, the controller is further configured to control the second solenoid valve 204 and the third solenoid valve 207 in a running indoor machine to turn on and control the first solenoid valve 203 to turn off, such that a refrigerant condensed by the outdoor machine directly return to the outdoor machine through the first connector 101, the second solenoid valve 204 and the third solenoid valve 207 in the running indoor machine, and the second connector 102 sequentially, in which the four-way valve of the outdoor machine is in the power-off state, and the first solenoid valves and the third solenoid valves in the indoor machines that are not running are turned on and the second solenoid valves therein are turned off.

That is, for the requirement of rapid defrosting, the first solenoid valve may be turned off, the second solenoid valve and the third solenoid valve may be turned on, the EXV2 of the running indoor machine may be regulated to the maximum opening degree, the four-way valve may be powered off (point a in communication with point b, and point c in communication with point d), a high-temperature and high-pressure gaseous refrigerant is directly condensed in the outdoor machine to defrost the outdoor heat exchanger, and then the condensed refrigerant returns to the liquid storage tank and thus to the compressor directly through the second solenoid valve, the third solenoid valve and the four-way valve d\c. The indoor machines that are not running may defrost outdoor heat exchanger rapidly according to a conventional defrosting action (i.e. in these indoor machines, EXV2 are regulated to the maximum opening degree, fans do not run, the first solenoid valves and the third solenoid valves are turned on, and the second solenoid valves are turned off), and meanwhile the room temperature corresponding to the running indoor machine is not lowered to ensure the comfort of the indoor environment.

For the VRF air conditioning system with dual control over temperature and humidity according to the embodiments of the present disclosure, in the case of normal heating or refrigerating requirements, the controller controls the VRF air conditioning system with dual control over temperature and humidity to enter the heating mode or the refrigerating mode accordingly and keep consistent with the conventional VRF air conditioning system, through control over the indoor throttle valve, the first solenoid valve, the second solenoid valve and the third solenoid valve in each indoor machine, thus ensuring the refrigerating and heating performances without resulting in the excessively long refrigerant flow path; in the case of the humidity requirement, the controller controls the indoor machine with the temperature and humidity control requirement to enter the temperature and humidity control mode to realize the function of dual control over temperature and humidity, through judgment on the system mode and corresponding control over the indoor throttle valve, the first solenoid valve, the second solenoid valve and the third solenoid valve in the indoor machine having the temperature and humidity control requirement. Thus, the VRF air conditioning system with dual control over temperature and humidity according to the embodiments of the present disclosure cannot only satisfy the requirement for dual control over temperature and humidity, but also avoid affecting the normal refrigerating and heating performances, which is energy-saving and environmental friendly, and fully meets user demands. Additionally, it is possible to ensure that the room temperature is not lowered during rapid defrosting, so as to improve the comfort of the indoor environment.

Figure 2:
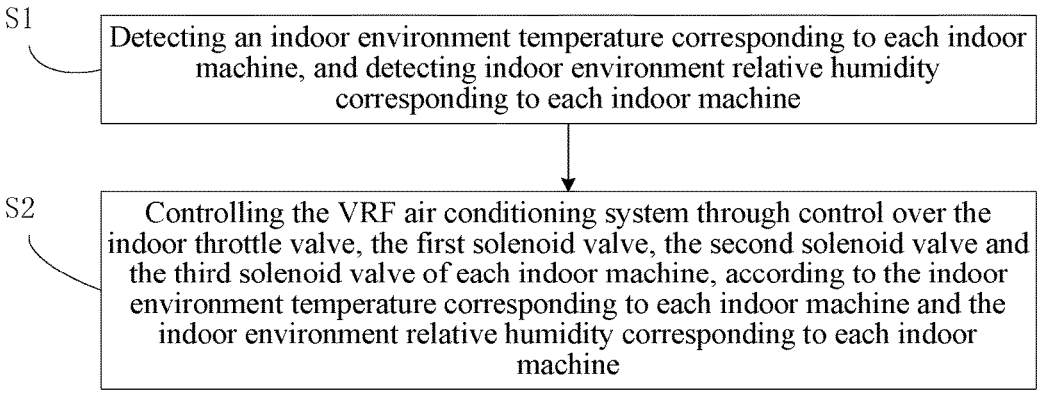
FIG. 2 is a flow chart of a control method for a VRF air conditioning system with dual control over temperature and humidity according to embodiments of the present disclosure.

FIG. 2 is a flow chart of a control method for a VRF air conditioning system with dual control over temperature and humidity according to embodiments of the present disclosure. The VRF air conditioning system with dual control over temperature and humidity is the VRF air conditioning system described in the above embodiments, and includes the plurality of indoor machines and the outdoor machine. The outdoor machine has the first connector and the second connector. Each of the plurality of indoor machines includes the indoor throttle valve, the first solenoid valve, the first heat exchanger and the second heat exchanger, the second solenoid valve, and the third solenoid valve. The first end of the indoor throttle valve is connected with the first connector, and the first end of the first solenoid valve is connected with the second end of the indoor throttle valve. The first end of the first heat exchanger is connected with the first end of the second heat exchanger, and the first node is provided between the first end of the first heat exchanger and the first end of the second heat exchanger. The first node is connected with the second end of the first solenoid valve. The first end of the second solenoid valve is connected with the first end of the first solenoid valve and the second end of the indoor throttle valve separately, the second end of the second solenoid valve is connected with the second end of the second heat exchanger, and the second node is provided between the second end of the second solenoid valve and the second end of the second heat exchanger. The first end of the third solenoid valve is connected with the second node, and the second end of the third solenoid valve is connected with the second end of the first heat exchanger and the second connector separately.

As shown in FIG. 2, the control method for the VRF air conditioning system with dual control over temperature and humidity includes the following steps.

Step S1: the indoor environment temperature corresponding to each indoor machine is detected, and the indoor environment relative humidity corresponding to each indoor machine is detected.

The temperature sensor may be provided at the air return port of the first heat exchanger in each indoor machine to detect the return air temperature $T_r$ so as to detect the indoor environment temperature. Moreover, a humidity sensor may be provided at the air return port of the first heat exchanger in each indoor machine to detect the indoor environment relative humidity.

Step S2: the VRF air conditioning system with dual control over temperature and humidity is controlled through control over the indoor throttle valve, the first solenoid valve, the second solenoid valve and the third solenoid valve of each indoor machine, according to the indoor environment temperature corresponding to each indoor machine and the indoor environment relative humidity corresponding to each indoor machine.

Figure 3:
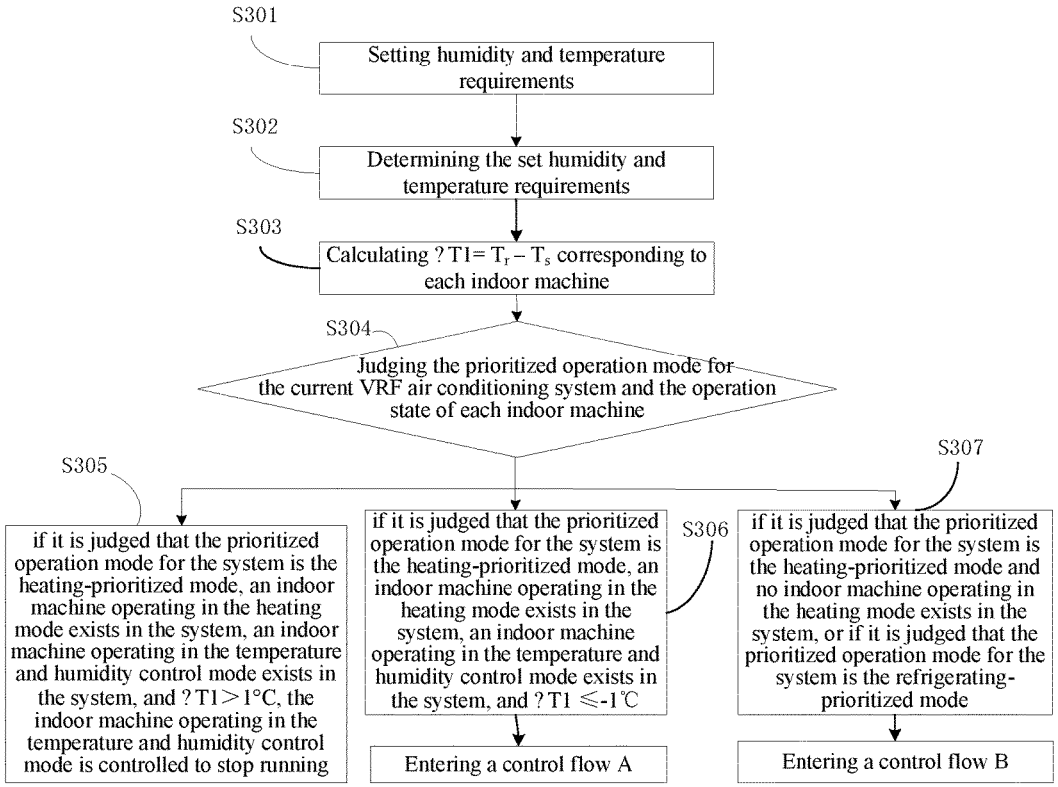
FIG. 3 is a flow chart of a control method for a VRF air conditioning system with dual control over temperature and humidity according to an embodiment of the present disclosure.

Specifically, in an embodiment of the present disclosure, as shown in FIG. 3, a control method for the above VRF air conditioning system includes the following steps.

Step S301: humidity and temperature requirements are set.

Step S302: the set humidity and temperature requirements are determined.

Step S303: a temperature difference value ΔT1 between the indoor environment temperature (like $T_r$) corresponding to each indoor machine and the set temperature $T_s$ is calculated in this formula of $\Delta T1=T_r-T_s$.

Step S304: the prioritized operation mode for the current VRF air conditioning system and the operation state of each indoor machine are judged.

Step S305: if it is judged that the prioritized operation mode for the current VRF air conditioning system is the heating-prioritized mode, an indoor machine operating in the heating mode exists in the current VRF air conditioning system, an indoor machine operating in the temperature and humidity control mode exists in the current VRF air conditioning system, and the ΔT1 corresponding to the indoor machine operating in the temperature and humidity control mode is greater than the first preset temperature (e.g. −1° C.), then the indoor machine operating in the temperature and humidity control mode is controlled to stop running, and since the indoor machine operating in the temperature and humidity control mode cannot achieve the decrease in the corresponding indoor environment temperature, the humidity control is put to rest until the temperature control returns to normal control.

Step S306: if it is judged that the prioritized operation mode for the current VRF air conditioning system is the heating-prioritized mode, an indoor machine operating in the heating mode exists in the current VRF air conditioning system, an indoor machine operating in the temperature and humidity control mode exists in the current VRF air conditioning system, and the ΔT1 corresponding to the indoor machine operating in the temperature and humidity control mode is less than or equal to the first preset temperature (e.g. −1° C.), then a control flow A is started.

Step S307: if it is judged that the prioritized operation mode for the current VRF air conditioning system is the heating-prioritized mode and no indoor machine operating in the heating mode exists in the current VRF air conditioning system, or if it is judged that the prioritized operation mode for the current VRF air conditioning system is the refrigerating-prioritized mode, then a control flow B is started.

Figure 4:
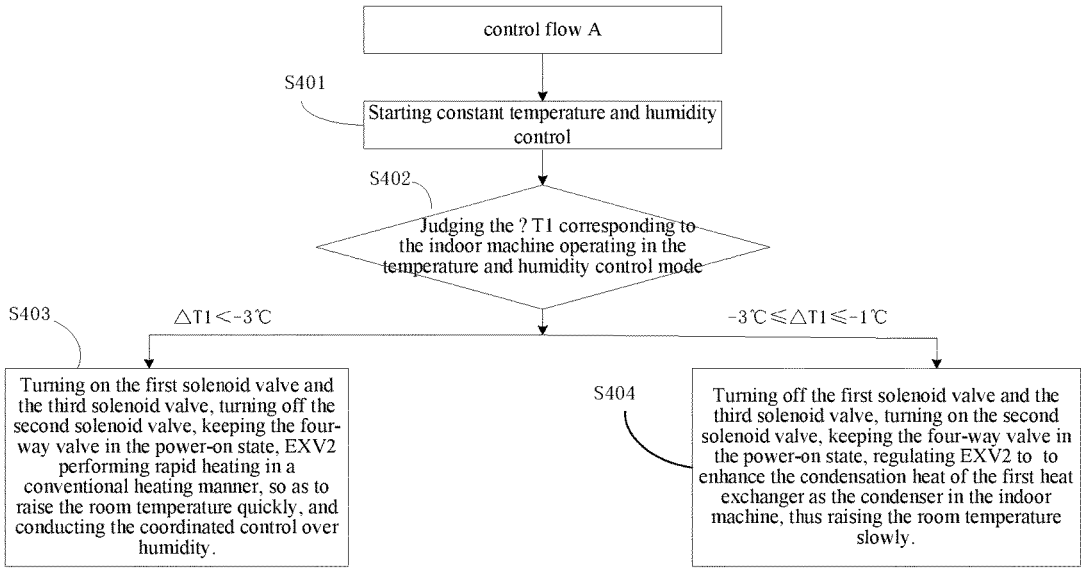
FIG. 4 is a control flow chart A in a control method for a VRF air conditioning system with dual control over temperature and humidity according to an embodiment of the present disclosure.

Specifically, as shown in FIG. 4, the control flow A includes the following steps.

Step S401: constant temperature and humidity control is started; if the system adopts the heating-prioritized principle, and the indoor machine operating in the heating mode exists, the four-way valve is powered on.

Step S402: the ΔT1 corresponding to the indoor machine operating in the temperature and humidity control mode is further judged.

Step S403: when the ΔT1 corresponding to the indoor machine operating in the temperature and humidity control mode is less than the second preset temperature (e.g. −3° C.), the first solenoid valve and the third solenoid valve of the indoor machine operating in the temperature and humidity control mode are controlled to turn on, and the second solenoid valve thereof is controlled to turn off, such that the indoor machine operating in the temperature and humidity control mode starts to operate in the heating mode to perform rapid heating, in which the second preset temperature is less than the first preset temperature. That is, if ΔT1<−3° C., the first solenoid valve and the third solenoid valve of the indoor machine started in the temperature and humidity control mode are turned on, the second solenoid valve thereof is turned off, the four-way valve keeps the power-on state, and the indoor throttle valve EXV2 performs rapid heating in a conventional heating manner, so as to raise the room temperature quickly. Meanwhile, the coordinated control over humidity is conducted.

Step S404: when the ΔT1 corresponding to the indoor machine operating in the temperature and humidity control mode is greater than or equal to the second preset temperature (e.g. −3° C.) and less than or equal to the first preset temperature (e.g. −1° C.), the first solenoid valve and the third solenoid valve of the indoor machine operating in the temperature and humidity control mode are controlled to turn off, and the second solenoid valve thereof is controlled to turn on, such that the first heat exchanger in the indoor machine operating in the temperature and humidity control mode acts as the condenser for heating and warming, and the second heat exchanger therein acts as the evaporator for refrigerating and dehumidifying, and meanwhile the evaporation of the evaporator is degraded by increasing the opening degree of the indoor throttle valve of the indoor machine operating in the temperature and humidity control mode. That is, if −3° C.≤ΔT1≤−1° C., the first solenoid valve and the third solenoid valve of the indoor machine started in the temperature and humidity control mode are turned off, the second solenoid valve thereof is turned on, the four-way valve keeps the power-on state, and the EXV2 is regulated to enhance the condensation heat of the first heat exchanger as the condenser in the indoor machine, thus raising the room temperature slowly, in which the speed regulation for opening degree of the EXV2 may be determined according to the value of ΔT1, i.e. the greater the absolute vale of ΔT1 is, the larger the regulation range of the EXV2 is, but still with maximum and minimum opening limits. Meanwhile, the coordinated control over humidity is conducted.

Figure 5:
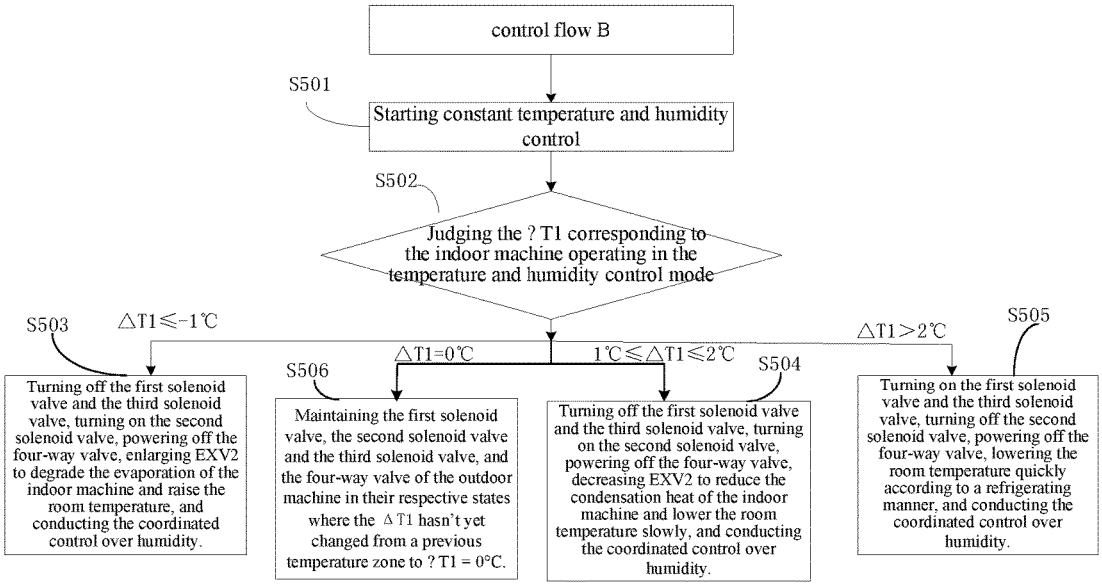
FIG. 5 is a control flow chart B in a control method for a VRF air conditioning system with dual control over temperature and humidity according to an embodiment of the present disclosure.

As shown in FIG. 5, the control flow B includes the following steps.

Step S501: constant temperature and humidity control is started; if the system adopts the refrigerating-prioritized principle or the heating-prioritized principle, all the started indoor machines are operating in the refrigerating mode or the temperature and humidity control mode, and the four-way valve is powered off.

Step S502: the ΔT1 corresponding to the indoor machine operating in the temperature and humidity control mode is judged.

Step S503: when the ΔT1 corresponding to the indoor machine operating in the temperature and humidity control mode is less than or equal to the third preset temperature (e.g. −1° C.), the first solenoid valve and the third solenoid valve of the indoor machine operating in the temperature and humidity control mode are controlled to turn off, and the second solenoid valve thereof is controlled to turn on, such that the second heat exchanger in the indoor machine operating in the temperature and humidity control mode acts as the condenser for heating and warming, and the first heat exchanger therein acts as the evaporator for refrigerating and dehumidifying, and the evaporation of the evaporator is degraded by increasing the opening degree of the indoor throttle valve of the indoor machine operating in the temperature and humidity control mode. That is, for the indoor machine started in the temperature and humidity control mode, if ΔT1≤−1° C., the first solenoid valve and the third solenoid valve of the indoor machine started in the temperature and humidity control mode are turned off, the second solenoid valve thereof is turned on, the EXV2 therein is controlled and its opening degree is increased appropriately, so as to degrade the evaporation of the indoor machine and raise the room temperature slowly, in which the regulation speed for opening degree of the EXV2 may be determined according to the value of ΔT1, i.e. the greater the absolute vale of ΔT1 is, the larger the regulation range of the EXV2 is, but still with maximum and minimum opening limits. Meanwhile, the coordinated control over humidity is conducted.

Step S504: when the ΔT1 corresponding to the indoor machine operating in the temperature and humidity control mode is greater than or equal to the fourth preset temperature (e.g. 1° C.) and less than or equal to the fifth preset temperature (e.g. 2° C.), the first solenoid valve and the third solenoid valve of the indoor machine operating in the temperature and humidity control mode are controlled to turn off, and the second solenoid valve thereof is controlled to turn on, such that the second heat exchanger in the indoor machine operating in the temperature and humidity control mode acts as the condenser for heating and warming, and the first heat exchanger therein acts as the evaporator for refrigerating and dehumidifying, and the condensation of the condenser is degraded by decreasing the opening degree of the indoor throttle valve of the indoor machine operating in the temperature and humidity control mode. That is, for the indoor machine started in the temperature and humidity control mode, if 1° C.≤ΔT1≤2° C., the first solenoid valve and the third solenoid valve of the indoor machine started in the temperature and humidity control mode are turned off, the second solenoid valve thereof is turned on, the EXV2 therein is controlled and its opening degree is reduced appropriately, so as to reduce the condensation heat of the indoor machine and lower the room temperature slowly, in which the regulation speed for opening degree of the EXV2 may be determined according to the value of ΔT1, i.e. the greater the absolute vale of ΔT1 is, the larger the regulation range of the EXV2 is, but still with maximum and minimum opening limits. Meanwhile, the coordinated control over humidity is conducted.

Step S505: when the ΔT1 corresponding to the indoor machine operating in the temperature and humidity control mode is greater than the fifth preset temperature (e.g. 2° C.), the first solenoid valve and the third solenoid valve of the indoor machine operating in the temperature and humidity control mode are controlled to turn on, and the second solenoid valve thereof is controlled to turn off, such that the indoor machine operating in the temperature and humidity control mode starts to operate in the refrigerating mode. That is, for the indoor machine started in the temperature and humidity control mode, if ΔT1>2° C., the first solenoid valve and the third solenoid valve of the indoor machine operating in the temperature and humidity control mode are turned on, the second solenoid valve thereof is turned off, the room temperature is lowered quickly according to a refrigerating manner, and the EXV2 is controlled in the normal refrigerating manner. Meanwhile, the coordinated control over humidity is conducted.

Step S506: when the ΔT1 corresponding to the indoor machine operating in the temperature and humidity control mode is equal to 0° C., the first solenoid valve, the second solenoid valve and the third solenoid valve of the indoor machine operating in the temperature and humidity control mode, and the four-way valve of the outdoor machine maintain their respective states where the ΔT1 hasn't yet changed from a previous temperature zone to ΔT1=0° C., and the EXV2 of the indoor machine operating in the temperature and humidity control mode maintains the current opening degree. Meanwhile, the coordinated control over humidity is conducted.

When the indoor machines in the VRF air conditioning system with dual control over temperature and humidity normally operate in the heating mode or the refrigerating mode, the first solenoid valves and the third solenoid valves are controlled to turn on, the second solenoid valves are controlled to turn off, and the electronic expansion valves EXV2 conduct normal regulation, without any difference from the conventional indoor machines for normal heating or refrigeration, which may avoid lengthening the refrigerant flow path and hence affecting the capacity during normal operation when the indoor machines are divided into two parts through series connection.

In an embodiment of the present disclosure, the indoor machine started in the temperature and humidity control mode also needs to take a coordinated control over humidity, in which the corresponding humidifier is controlled to turn on or off based on the indoor environment relative humidity corresponding to the indoor machine operating in the temperature and humidity control mode, such that the indoor environment relative humidity corresponding to the indoor machine operating in the temperature and humidity control mode may meet preset requirements.

Figure 6:
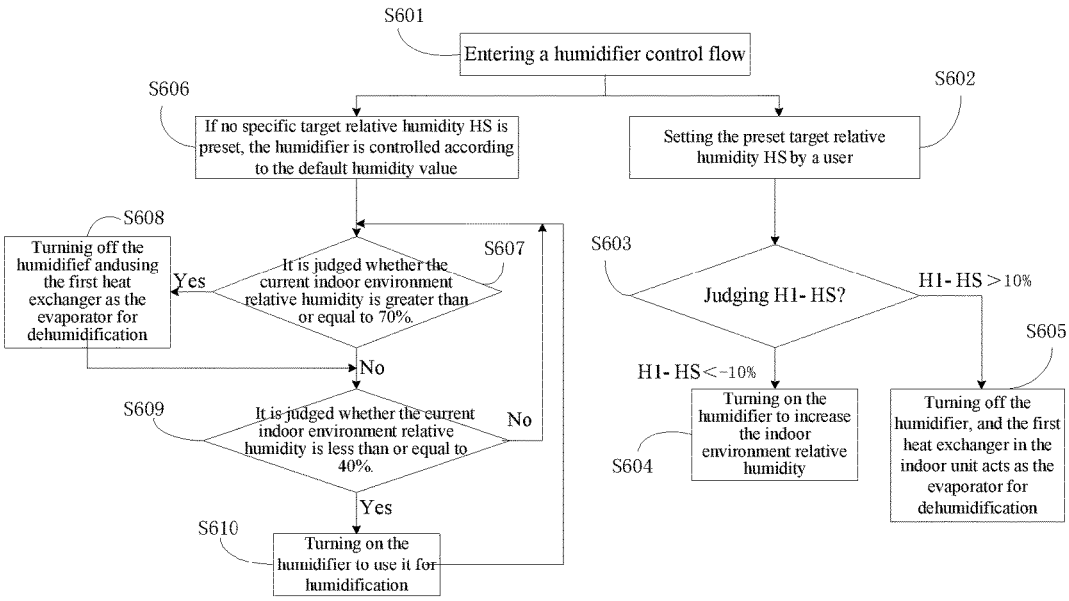
FIG. 6 is a flow chart of a coordinated control over humidity according to an embodiment of the present disclosure.

Specifically, as shown in FIG. 6, the coordinated control over humidity includes the following steps.

Step S601: a humidifier control flow is started.

Step S602: a user sets the preset target relative humidity HS (the value of HS generally ranges from 0.4 to 0.7).

Step S603: the difference value (H1−HS) between the indoor environment relative humidity H1 and the target relative humidity HS is judged.

Step S604: if H1−HS<−10%, the humidifier is turned on to increase the indoor environment relative humidity.

Step S605: if H1−HS>10%, the humidifier is turned off, and the first heat exchanger in the indoor machine acts as the evaporator for dehumidification.

Step S606: if no specific target relative humidity HS is preset, the humidifier is controlled according to the default humidity value.

Step S607: it is judged whether the current indoor environment relative humidity is greater than or equal to 70%. If yes, step S608 is executed; if not, step S609 is executed.

Step S608: the humidifier is turned off and the first heat exchanger in the indoor machine acts as the evaporator for dehumidification, and then step S609 is executed.

Step S609: it is judged whether the current indoor environment relative humidity is less than or equal to 40%. If yes, step S610 is executed; if not, step S607 is executed again.

Step S610: the humidifier is turned on and utilized for humidification, and then step S607 is executed again.

Through the control over the humidifier, it is possible to make the indoor environment relative humidity meet the preset requirements, for example, to ensure −10%≤H1−HS≤10%, or to keep the indoor environment relative humidity in a range of 40% to 70%.

In the embodiment of the present disclosure, water of the humidifier may be obtained by filtering condensation water from the evaporator, or for more convenience of water supply, the humidifier may be mounted by adding a port through electric control and introducing a power line to a predetermined position in the indoor environment.

In an embodiment of the present disclosure, when the VRF air conditioning system with dual control over temperature and humidity performs rapid defrosting, the second solenoid valve and the third solenoid valve in the running indoor machine are further controlled to turn on and the first solenoid valve therein is further controlled to turn off, such that the refrigerant condensed by the outdoor machine directly return to the outdoor machine through the first connector, the second solenoid valve and the third solenoid valve in the running indoor machine, and the second connector sequentially, in which the four-way valve of the outdoor machine is in the power-off state, and the first solenoid valves and the third solenoid valves in the indoor machines that are not running are turned on and the second solenoid valves therein are turned off.

That is, for the requirement of rapid defrosting, the first solenoid valve may be turned off, the second solenoid valve and the third solenoid valve may be turned on, the EXV2 of the running indoor machine may be regulated to the maximum opening degree, the four-way valve may be powered off (point a in communication with point b, and point c in communication with point d), the high-temperature and high-pressure gaseous refrigerant is directly condensed in the outdoor machine to defrost the outdoor heat exchanger, and then the condensed refrigerant returns to the liquid storage tank and thus to the compressor directly through the second solenoid valve, the third solenoid valve and the four-way valve d\c. The indoor machines that are not running may defrost outdoor heat exchanger rapidly according to the conventional defrosting action (i.e. in these indoor machines, EXV2 are regulated to the maximum opening degree, fans do not run, the first solenoid valves and the third solenoid valves are turned on, and the second solenoid valves are turned off), and meanwhile the room temperature corresponding to the running indoor machine is not lowered to ensure the comfort of the indoor environment.

With the control method for the VRF air conditioning system with dual control over temperature and humidity according to the embodiments of the present disclosure, in the case of normal heating or refrigerating requirements, the VRF air conditioning system with dual control over temperature and humidity is controlled to enter the heating mode or the refrigerating mode accordingly and keep consistent with the conventional VRF air conditioning system, through control over the indoor throttle valve, the first solenoid valve, the second solenoid valve and the third solenoid valve in each indoor machine, thus ensuring the refrigerating and heating performances without resulting in the excessively long refrigerant flow path; in the case of the humidity requirement, the indoor machine with the temperature and humidity control requirement is controlled to enter the temperature and humidity control mode to realize the function of dual control over temperature and humidity, through judgment on the system mode and corresponding control over the indoor throttle valve, the first solenoid valve, the second solenoid valve and the third solenoid valve in the indoor machine having the temperature and humidity control requirement. Thus, the control method for the VRF air conditioning system with dual control over temperature and humidity according to the embodiments of the present disclosure cannot only satisfy the requirement for dual control over temperature and humidity, but also avoid affecting the normal refrigerating and heating performances, which is energy-saving and environmental friendly, and fully meets user demands. Additionally, it is possible to ensure that the room temperature is not lowered during rapid defrosting, so as to improve the comfort of the indoor environment.

In the specification, it is to be understood that terms such as "central," "longitudinal", "lateral", "length," "width," "thickness," "upper," "lower," "front," "rear," "left," "right," "vertical," "horizontal," "top," "bottom," "inner," "outer," "clockwise," "counterclockwise," "axial," "radial," and "circumferential" should be construed to refer to the orientation or the position as then described or as shown in the drawings under discussion. These relative terms are only used to simplify description of the present disclosure, and do not indicate or imply that the device or element referred to must have a particular orientation, or constructed or operated in a particular orientation. Thus, these terms cannot be constructed to limit the present disclosure.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, "a plurality of" means two or more than two, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature. Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the appearances of the above phrases throughout this specification are not necessarily referring to the same embodiment or example of the present disclosure. Furthermore, the particular features, structures, materials, or characteristics may be combined in any suitable manner in one or more embodiments or examples.

Although embodiments of the present disclosure have been shown and described, it would be appreciated by those skilled in the art that changes, modifications, alternatives and variations can be made in the embodiments without departing from the scope of the present disclosure.

What is claimed is:

1. A variable refrigerant flow (VRF) air conditioning system with dual control over temperature and humidity, comprising:

an outdoor machine having a first connector and a second connector;

a controller; and a plurality of indoor machines, each comprising:

an indoor throttle valve having a first end connected with the first connector;

a first solenoid valve having a first end connected with a second end of the indoor throttle valve;

a first heat exchanger and a second heat exchanger, wherein a first end of the first heat exchanger is connected with a first end of the second heat exchanger, and a first node is provided between the first end of the first heat exchanger and the first end of the second heat exchanger and is connected with a second end of the first solenoid valve;

a second solenoid valve having a first end connected with the first end of the first solenoid valve and the second end of the indoor throttle valve respectively, and a second end connected with a second end of the second heat exchanger, wherein a second node is provided between the second end of the second solenoid valve and the second end of the second heat exchanger;

a third solenoid valve having a first end connected with the second node, and a second end connected with a second end of the first heat exchanger and the second connector respectively;

a temperature detector configured to detect an indoor environment temperature; and a humidity detector configured to detect indoor environment relative humidity;

wherein the controller is connected with the indoor throttle valve, the first solenoid valve, the second solenoid valve, the third solenoid valve, the temperature detector and the humidity detector of each indoor machine respectively, and is configured to control the VRF air conditioning system through control over the indoor throttle valve, the first solenoid valve, the second solenoid valve and the third solenoid valve of each indoor machine.

2. The VRF air conditioning system according to claim 1, wherein the controller is configured to calculate a temperature difference value ΔT1 between the indoor environment temperature corresponding to each indoor machine and a set temperature, and judge a prioritized operation mode for the VRF air conditioning system and an operation state of each indoor machine, wherein when it is judged that the prioritized operation mode for the VRF air conditioning system is a heating-prioritized mode, an indoor machine operating in a heating mode exists in the VRF air conditioning system, an indoor machine operating in a temperature and humidity control mode exists in the VRF air conditioning system, and ΔT1 corresponding to the indoor machine operating in the temperature and humidity control mode is greater than a first preset temperature, then the controller is configured to control the indoor machine operating in the temperature and humidity control mode to stop running.

3. The VRF air conditioning system according to claim 2, wherein when it is judged that the prioritized operation mode for the VRF air conditioning system is the heating-prioritized mode, the indoor machine operating in the heating mode exists in the VRF air conditioning system, the indoor machine operating in the temperature and humidity control mode exists in the VRF air conditioning system, and the ΔT1 corresponding to the indoor machine operating in the temperature and humidity control mode is less than or equal to the first preset temperature, then the controller is configured to further judge the ΔT1 corresponding to the indoor machine operating in the temperature and humidity control mode, wherein when the ΔT1 corresponding to the indoor machine operating in the temperature and humidity control mode is less than a second preset temperature, the controller is configured to control the first solenoid valve and the third solenoid valve of the indoor machine operating in the temperature and humidity control mode to turn on, and control the second solenoid valve thereof to turn off, such that the indoor machine operating in the temperature and humidity control mode starts to operate in the heating mode, in which the second preset temperature is less than the first preset temperature;

when the ΔT1 corresponding to the indoor machine operating in the temperature and humidity control mode is greater than or equal to the second preset temperature and less than or equal to the first preset temperature, the controller is configured to control the first solenoid valve and the third solenoid valve of the indoor machine operating in the temperature and humidity control mode to turn off, and control the second solenoid valve thereof to turn on, such that the first heat exchanger in the indoor machine operating in the temperature and humidity control mode acts as a condenser for heating and warming, and the second heat exchanger therein acts as an evaporator for refrigerating and dehumidifying, and meanwhile the controller is configured to degrade evaporation of the evaporator by increasing an opening degree of the indoor throttle valve of the indoor machine operating in the temperature and humidity control mode.

4. The VRF air conditioning system according to claim 3, wherein each indoor machine further comprises a humidifier configured to humidify the indoor environment, in which the controller is further configured to control the corresponding humidifier to turn on or off based on the indoor environment relative humidity corresponding to the indoor machine operating in the temperature and humidity control mode, such that the indoor environment relative humidity corresponding to the indoor machine operating in the temperature and humidity control mode meets preset requirements.

5. The VRF air conditioning system according to claim 2, wherein when it is judged that the prioritized operation mode for the VRF air conditioning system is the heating-prioritized mode and no indoor machine operating in the heating mode exists in the VRF air conditioning system, or when it is judged that the prioritized operation mode for the VRF air conditioning system is a refrigerating-prioritized mode, wherein when the ΔT1 corresponding to the indoor machine operating in the temperature and humidity control mode is less than or equal to a third preset temperature, the controller is configured to control the first solenoid valve and the third solenoid valve of the indoor machine operating in the temperature and humidity control mode to turn off, and control the second solenoid valve thereof to turn on, such that the second heat exchanger in the indoor machine operating in the temperature and humidity control mode acts as the condenser for heating and warming, and the first heat exchanger therein acts as the evaporator for refrigerating and dehumidifying, and meanwhile the controller is configured to degrade evaporation of the evaporator by increasing the opening degree of the indoor throttle valve in the indoor machine operating in the temperature and humidity control mode;

when the ΔT1 corresponding to the indoor machine operating in the temperature and humidity control mode is greater than or equal to a fourth preset temperature and less than or equal to a fifth preset temperature, the controller is configured to control the first solenoid valve and the third solenoid valve of the indoor machine operating in the temperature and humidity control mode to turn off, and control the second solenoid valve thereof to turn on, such that the second heat exchanger in the indoor machine operating in the temperature and humidity control mode acts as the condenser for heating and warming, and the first heat exchanger therein acts as the evaporator for refrigerating and dehumidifying, and the controller is configured to degrade condensation of the condenser by decreasing the opening degree of the indoor throttle valve in the indoor machine operating in the temperature and humidity control mode;

when the ΔT1 corresponding to the indoor machine operating in the temperature and humidity control mode is greater than the fifth preset temperature, the controller is configured to control the first solenoid valve and the third solenoid valve of the indoor machine operating in the temperature and humidity control mode to turn on, and control the second solenoid valve thereof to turn off, such that the indoor machine operating in the temperature and humidity control mode starts to operate in a refrigerating mode.

6. The VRF air conditioning system according to claim 5, wherein each indoor machine further comprises a humidifier configured to humidify the indoor environment, in which the controller is further configured to control the corresponding humidifier to turn on or off based on the indoor environment relative humidity corresponding to the indoor machine operating in the temperature and humidity control mode, such that the indoor environment relative humidity corresponding to the indoor machine operating in the temperature and humidity control mode meets preset requirements.

7. The VRF air conditioning system according to claim 1, wherein when the VRF air conditioning system performs rapid defrosting, the controller is further configured to control the second solenoid valve and the third solenoid valve in a running indoor machine to turn on and control the first solenoid valve therein to turn off, such that a refrigerant condensed by the outdoor machine directly return to the outdoor machine through the first connector, the second solenoid valve and the third solenoid valve in the running indoor machine, and the second connector sequentially, in which a four-way valve of the outdoor machine is in a power-off state, and the first solenoid valve and the third solenoid valve in an indoor machine that is not running are turned on and the second solenoid valve therein is turned off.

8. The VRF air conditioning system according to claim 1, wherein a first throttling element is further provided between the first node and the first end of the first heat exchanger, and a second throttling element is further provided between the first node and the first end of the second heat exchanger.

9. The VRF air conditioning system according to claim 1, wherein the outdoor machine includes a compressor, a liquid storage tank, a four-way valve, an outdoor heat exchanger and an outdoor throttle valve.

10. The VRF air conditioning system according to claim 1, wherein the indoor throttle valve of an indoor machine is associated with parameters of thereof as well as parameters of other indoor machines.

11. A control method for a VRF air conditioning system with dual control over temperature and humidity, wherein the VRF air conditioning system with dual control over temperature and humidity comprises a plurality of indoor machines and an outdoor machine; the outdoor machine has a first connector and a second connector; each of the plurality of indoor machines includes an indoor throttle valve, a first solenoid valve, a first heat exchanger and a second heat exchanger, a second solenoid valve, and a third solenoid valve; a first end of the indoor throttle valve is connected with the first connector, and a first end of the first solenoid valve is connected with a second end of the indoor throttle valve; a first end of the first heat exchanger is connected with a first end of the second heat exchanger, and a first node is provided between the first end of the first heat exchanger and the first end of the second heat exchanger; the first node is connected with a second end of the first solenoid valve; a first end of the second solenoid valve is connected with the first end of the first solenoid valve and the second end of the indoor throttle valve respectively, a second end of the second solenoid valve is connected with a second end of the second heat exchanger, and a second node is provided between the second end of the second solenoid valve and the second end of the second heat exchanger; a first end of the third solenoid valve is connected with the second node, and a second end of the third solenoid valve is connected with a second end of the first heat exchanger and the second connector respectively; wherein the control method comprises following steps:

detecting an indoor environment temperature corresponding to each indoor machine, and detecting indoor environment relative humidity corresponding to each indoor machine; and controlling the VRF air conditioning system through control over the indoor throttle valve, the first solenoid valve, the second solenoid valve and the third solenoid valve of each indoor machine, according to the indoor environment temperature corresponding to each indoor machine and the indoor environment relative humidity corresponding to each indoor machine.

12. The control method according to claim 11, further comprising: calculating a temperature difference value ΔT1 between the indoor environment temperature corresponding to each indoor machine and a set temperature, and judging a prioritized operation mode for the VRF air conditioning system and an operation state of each indoor machine, wherein when it is judged that the prioritized operation mode for the VRF air conditioning system is a heating-prioritized mode, an indoor machine operating in a heating mode exists in the VRF air conditioning system, an indoor machine operating in a temperature and humidity control mode exists in the VRF air conditioning system, and ΔT1 corresponding to the indoor machine operating in the temperature and humidity control mode is greater than a first preset temperature, then the indoor machine operating in the temperature and humidity control mode is controlled to stop running.

13. The control method according to claim 12, wherein when it is judged that the prioritized operation mode for the VRF air conditioning system is the heating-prioritized mode, the indoor machine operating in the heating mode exists in the VRF air conditioning system, the indoor machine operating in the temperature and humidity control mode exists in the VRF air conditioning system, and the ΔT1 corresponding to the indoor machine operating in the temperature and humidity control mode is less than or equal to the first preset temperature, then the ΔT1 corresponding to the indoor machine operating in the temperature and humidity control mode is further judged, wherein when the ΔT1 corresponding to the indoor machine operating in the temperature and humidity control mode is less than a second preset temperature, the first solenoid valve and the third solenoid valve of the indoor machine operating in the temperature and humidity control mode are controlled to turn on, and the second solenoid valve thereof is controlled to turn off, such that the indoor machine operating in the temperature and humidity control mode starts to operate in the heating mode, in which the second preset temperature is less than the first preset temperature;

when the ΔT1 corresponding to the indoor machine operating in the temperature and humidity control mode is greater than or equal to the second preset temperature and less than or equal to the first preset temperature, the first solenoid valve and the third solenoid valve of the indoor machine operating in the temperature and humidity control mode are controlled to turn off, and the second solenoid valve thereof is controlled to turn on, such that the first heat exchanger in the indoor machine operating in the temperature and humidity control mode acts as a condenser for heating and warming, and the second heat exchanger acts therein as an evaporator for refrigerating and dehumidifying, and meanwhile evaporation of the evaporator is degraded by increasing an opening degree of the indoor throttle valve of the indoor machine operating in the temperature and humidity control mode.

14. The control method according to claim 13, further comprising: controlling a corresponding humidifier to turn on or off based on the indoor environment relative humidity corresponding to the indoor machine operating in the temperature and humidity control mode, such that the indoor environment relative humidity corresponding to the indoor machine operating in the temperature and humidity control mode meets preset requirements.

15. The control method according to claim 12, wherein when it is judged that the prioritized operation mode for the VRF air conditioning system is the heating-prioritized mode and no indoor machine operating in the heating mode exists in the VRF air conditioning system, or when it is judged that the prioritized operation mode for the VRF air conditioning system is a refrigerating-prioritized mode, wherein when the ΔT1 corresponding to the indoor machine operating in the temperature and humidity control mode is less than or equal to a third preset temperature, the first solenoid valve and the third solenoid valve of the indoor machine operating in the temperature and humidity control mode are controlled to turn off, and the second solenoid valve thereof is controlled to turn on, such that the second heat exchanger in the indoor machine operating in the temperature and humidity control mode acts as the condenser for heating and warming, and the first heat exchanger therein acts as the evaporator for refrigerating and dehumidifying, and the evaporation of the evaporator is degraded by increasing the opening degree of the indoor throttle valve of the indoor machine operating in the temperature and humidity control mode;

when the ΔT1 corresponding to the indoor machine operating in the temperature and humidity control mode is greater than or equal to a fourth preset temperature and less than or equal to a fifth preset temperature, the first solenoid valve and the third solenoid valve of the indoor machine operating in the temperature and humidity control mode are controlled to turn off, and the second solenoid valve thereof is controlled to turn on, such that the second heat exchanger in the indoor machine operating in the temperature and humidity control mode acts as the condenser for heating and warming, and the first heat exchanger therein acts as the evaporator for refrigerating and dehumidifying, and condensation of the condenser is degraded by decreasing the opening degree of the indoor throttle valve of the indoor machine operating in the temperature and humidity control mode;

when the ΔT1 corresponding to the indoor machine operating in the temperature and humidity control mode is greater than the fifth preset temperature, the first solenoid valve and the third solenoid valve of the indoor machine operating in the temperature and humidity control mode are controlled to turn on, and the second solenoid valve thereof is controlled to turn off, such that the indoor machine operating in the temperature and humidity control mode starts to operate in a refrigerating mode.

16. The control method according to claim 15, further comprising: controlling a corresponding humidifier to turn on or off based on the indoor environment relative humidity corresponding to the indoor machine operating in the temperature and humidity control mode, such that the indoor environment relative humidity corresponding to the indoor machine operating in the temperature and humidity control mode meets preset requirements.

17. The control method according to claim 11, wherein when the VRF air conditioning system with dual control over temperature and humidity performs rapid defrosting, the second solenoid valve and the third solenoid valve in a running indoor machine are further controlled to turn on and the first solenoid valve therein is further controlled to turn off, such that a refrigerant condensed by the outdoor machine directly return to the outdoor machine through the first connector, the second solenoid valve and the third solenoid valve in the running indoor machine, and the second connector sequentially, in which a four-way valve of the outdoor machine is in a power-off state, and the first solenoid valve and the third solenoid valve in an indoor machine that is not running are turned on and the second solenoid valve therein is turned off.

* * * * *